US005216433A

United States Patent [19]

Kurtz et al.

[11] Patent Number: 5,216,433

[45] Date of Patent: Jun. 1, 1993

[54] POLARIMETRIC ANTENNA

[75] Inventors: Louis A. Kurtz; Robert L. Eisenhart, both of Woodland Hills; Eric L. Holzman, Rancho Palos Verdes; Ralston S. Robertson, Northridge, all of Calif.

[73] Assignee: Hughes Aircraft Company, Los Angeles, Calif.

[21] Appl. No.: 792,557

[22] Filed: Nov. 15, 1991

[51] Int. Cl.[5] ..... H01Q 13/00

[52] U.S. Cl. ..... 343/786; 333/137

[58] Field of Search ..... 343/772, 775, 784, 786; 333/121, 122, 125, 137, 21 R

[56] References Cited

U.S. PATENT DOCUMENTS

| | | | |
|---|---|---|---|
| 2,682,610 | 6/1954 | King | 343/786 |
| 3,395,059 | 7/1968 | Butler et al. | 343/786 |
| 3,864,683 | 2/1975 | Mörz | 343/786 |
| 4,047,128 | 9/1977 | Marz | 343/786 |
| 4,420,756 | 12/1983 | Hamada et al. | 333/122 |
| 4,801,945 | 1/1989 | Luly | 343/772 |
| 5,066,959 | 11/1991 | Huder | 343/786 |

FOREIGN PATENT DOCUMENTS

| | | | |
|---|---|---|---|
| 2607809 | 9/1977 | Fed. Rep. of Germany | 343/786 |
| 0058336 | 5/1979 | Japan | 343/786 |

*Primary Examiner*—Michael C. Wimer

*Assistant Examiner*—Tan Ho

*Attorney, Agent, or Firm*—R. M. Heald; C. D. Brown; W. K. Denson-Low

[57] ABSTRACT

A polarimetric antenna (20) comprises a length of circular waveguide (30) having a sidewall (32) with a cylindrical internal surface (34). The sidewall (32) has two longitudinal slots (38) that extend parallel to a longitudinal axis (36) of the waveguide (30) and are symmetrically positioned with respect to the circumference of the circular waveguide (30). A first rectangular waveguide (40) communicates with one of the longitudinal slots (38), and a second rectangular waveguide (42) communicates with the other longitudinal slot (38), but is short circuited by a closure (44) at one end thereof. A transverse closure (46) is positioned over the circular waveguide (30) at one end, the closure (46) having a first and a second transverse slot (48, 50) therein. These slots (48, 50), which are preferably arcuate in form, are positioned symmetrically with respect to a longitudinal axis (36) of the circular waveguide (30). A third rectangular waveguide (52) is in communication with the first transverse slot (48), and a fourth rectangular waveguide (54) is in communication with the second transverse slot (50). The two rectangular waveguides (52, 54) are preferably excited through an E-plane folded magic Tee (58). This antenna (20) is used to radiate submicrowave, microwave, or millimeter wave energy in applications such as a cassegrain tracking antenna (22).

14 Claims, 3 Drawing Sheets

POLARIMETRIC ANTENNA

BACKGROUND OF THE INVENTION

This invention relates to antennas, and, more particularly, to a structurally simple polarimetric antenna of particular use in the sub-microwave, microwave, and millimeter wave frequency ranges.

Microwaves are electromagnetic waves having frequencies of from about 1 GHz (gigahertz) to about 30 GHz. Millimeter waves have even higher frequencies of from about 30 GHz to about 300–500 GHz. Microwaves and millimeter waves are often used to transmit electromagnetic energy in a variety of applications, including radar and communications. Microwaves and millimeter waves can either be radiated through free space from place to place, or carried along a conductive path.

For radar tracking applications, in which radiated electromagnetic energy is used to track objects such as spacecraft, the microwave or millimeter wave electromagnetic energy is generated and propagated through a waveguide to an antenna. The energy is then radiated from the antenna, operating in a transmitting mode, through free space to the object being tracked. A portion of the energy reflects from the object back to the antenna, now operating in a receiving mode, and is received. The electromagnetic energy is transmitted back through the waveguide to a receiver and analyzed.

It has long been known that various transmitted and received modes of such electromagnetic energy can be used to provide information about the path and speed of the object being tracked. A tracking algorithm typically specifies the nature of the electromagnetic energy pattern to be radiated toward the object being tracked and, based upon such a radiated pattern, provides a procedure for analyzing the reflected pattern. For example, in one tracking algorithm developed by Cook and Lowell and described in "The Autotrack System," The Bell System Technical Journal, July 1963, pages 1283–1307, the antenna must transmit a circularly polarized sum pattern and receive sum vertical ($\Sigma_v$), sum horizontal ($\Sigma_h$) and difference ($\Delta$) patterns.

Once a tracking algorithm is adopted, an antenna and antenna feed must be designed to permit the selected electromagnetic signals to be radiated and received. For complex transmitting and receiving requirements, particularly where circularly polarized patterns must be transmitted and both polarization components received, the conventional approach has been to use complex antenna feeds. Such mechanically complex antenna feed systems tend to be rather costly. Manufacturing procedures are complicated and labor intensive, particularly for feeds designed for use at millimeter-wave frequencies.

There is an ongoing need for improved microwave and millimeter wave polarimetric antennas for general use, and particularly for use in tracking antennas and antenna feed systems. The antennas must be capable of transmitting and receiving the required types of electromagnetic energy patterns, and should be less complex than those already available. The present invention fulfills this need, and further provides related advantages.

SUMMARY OF THE INVENTION

The present invention provides a polarimetric antenna that is structurally simple and usable with only a single antenna horn rather than multiple horns. It is compact and suitable for use in cassegrain-type tracking antennas. It is useful over a broad frequency range from below the microwave range and including both the microwave and millimeter-wave ranges. The antenna can excite two orthogonal linearly polarized modes ($\Sigma_v$ and $\Sigma_h$) and a radially polarized difference ($\Delta$) mode in the antenna. Moreover, the particular structural features of the antenna can be adjusted to provide an impedance match to its inputs.

In accordance with the invention, a polarimetric antenna comprises a length of circular waveguide having a sidewall with a cylindrical internal surface. The sidewall has a first longitudinal slot and a second longitudinal slot therein that extend parallel to a longitudinal axis of the waveguide and are symmetrically positioned with respect to the circumference of the circular waveguide. A first rectangular waveguide communicates with the first longitudinal slot, and a second rectangular waveguide communicates with the second longitudinal slot, but is short circuited by a closure at one end thereof. A transverse closure is positioned over the circular waveguide at one end, the closure having a first and a second transverse slot therein. These slots are positioned symmetrically with respect to the longitudinal axis of the circular waveguide. A third rectangular waveguide is in communication with the first transverse slot, and a fourth rectangular waveguide is in communication with the second transverse slot.

The transmission and reception of the antenna are through the open end of the circular waveguide. A conical horn may be attached to that open end to control gain and beam width. The radiated or received signals can be beamed simply through the conical horn alone or through an antenna reflector such as a cassegrain arrangement.

The slots in the transverse closure are preferably arcuate and arranged symmetrically about the center of the closure. The rectangular waveguide feeds to the slots are preferably through an E-plane, folded magic Tee matched for optimum energy transfer between ports that permits electromagnetic signals to be transmitted or received either in-phase or 180 degrees out of phase. If the two arcuate slots are excited in phase, a $TE_{11}$ circular waveguide mode is generated. This mode gives rise to a vertically polarized sum signal, $\Sigma_v$. If the two arcuate slots are excited 180 degrees out of phase, a $TM_{01}$ circular waveguide mode is excited. This mode gives rise to the difference signal, $\Delta$. If the longitudinal slots are excited and the slots are spaced one-quarter wavelength from the transverse closure, another $TE_{11}$ circular waveguide mode is excited. The electrical field of this mode is 90 degrees out of phase with the mode generated by the two arcuate slots and excites the $\Sigma_h$ signal. By exciting the two $TE_{11}$ modes in a phased manner, a circularly polarized sum pattern is radiated. The same signals can be received in the inverse manner.

The present antenna is used with a single antenna horn and may be incorporated into a cassegrain tracking antenna. As will be described, the antenna can be optimized for particular wavelengths of the electromagnetic energy through adjustment of slot lengths and other structural dimensions. Other features and advantages of the invention will be apparent from the following more detailed description of the preferred embodiments, taken in conjunction with the accompanying drawings, which illustrate, by way of example, the principles of the invention.

DETAILED DESCRIPTION OF THE INVENTION

Figure 1:
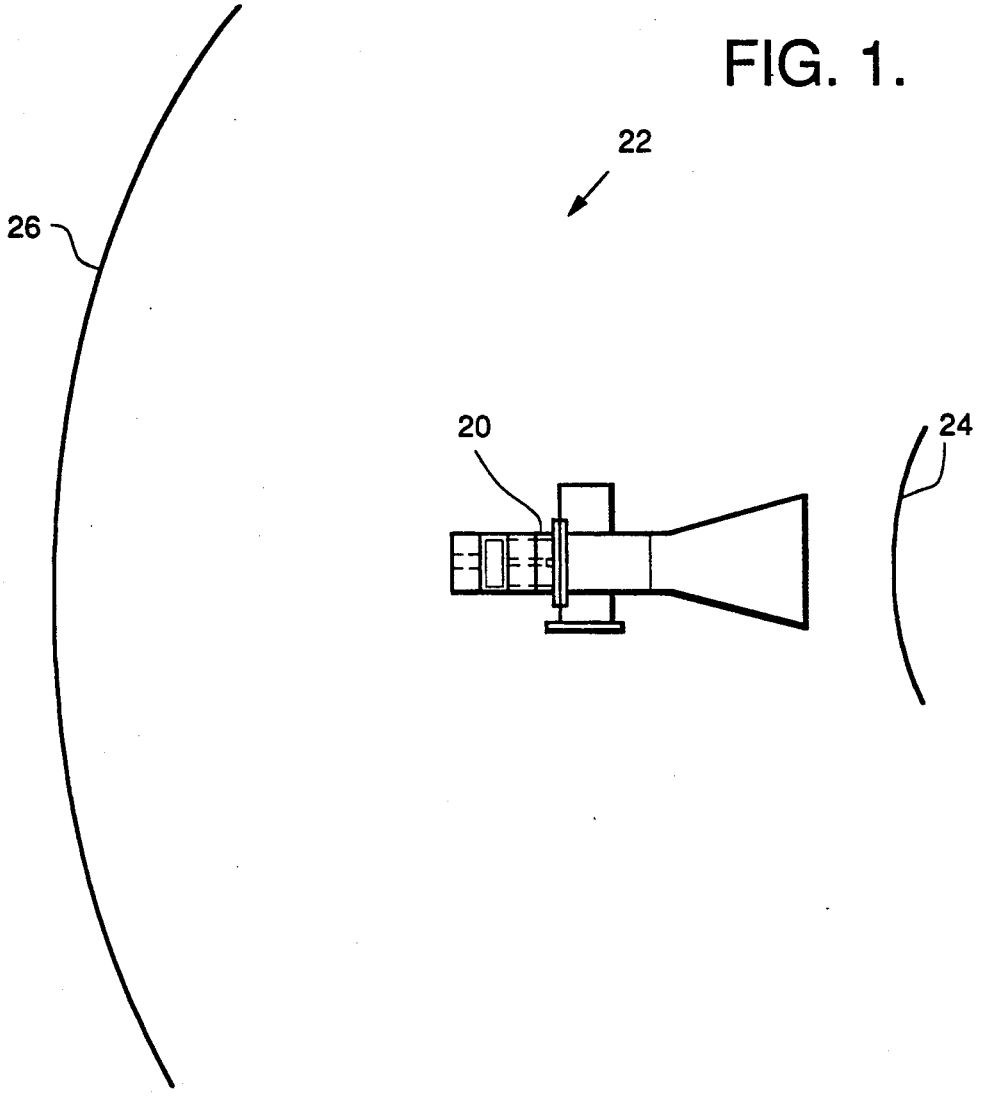
FIG. 1 is a diagrammatic perspective view of a cassegrain tracking antenna.

A polarimetric antenna 20 according to the present invention is shown in FIG. 1. In one application of particular interest, also illustrated in FIG. 1, the polarimetric antenna 20 provides a microwave feed signal to a microwave cassegrain tracking antenna 22. In this embodiment, the antenna 20 is dimensioned for use at about 35 GHz, but, as discussed previously, the polarimetric antenna may be used for higher or lower frequencies as well.

The cassegrain tracking antenna 22 utilizes the polarimetric antenna 20 as a feed device, directing the beam of microwave energy produced by the antenna 20 against a subreflector 24. The subreflector 24 reflects the beam of microwave energy to a main reflector 26, which reflects it toward a target (not shown) or other object. Received signals are reflected along the inverse path. By way of illustration of the dimensions involved and not of limitation, in a preferred embodiment used for a microwave signal of 35 GHz, the subreflector 24 has a diameter of 2 inches and the main reflector 26 has a diameter of 13 inches.

Figure 2:
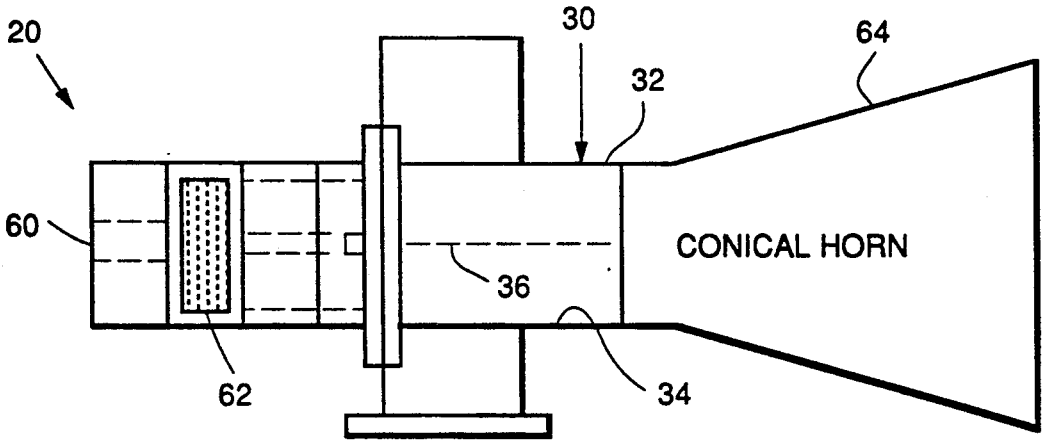
FIG. 2 is a side elevational view of a microwave antenna.
Figure 3:
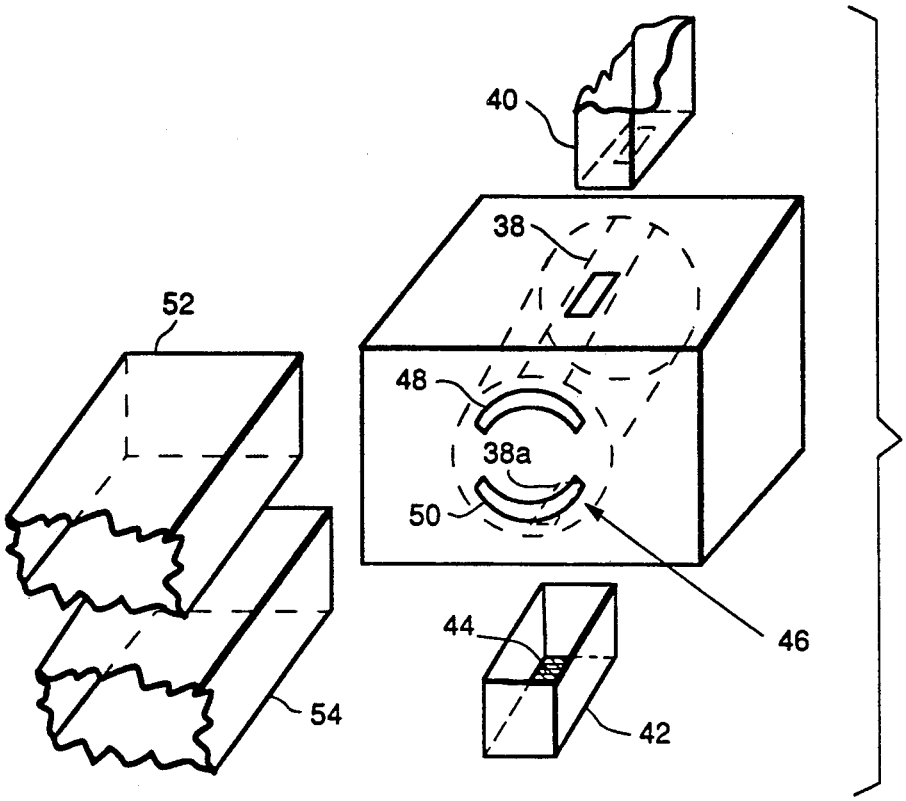
FIG. 3 is a perspective exploded view of the central mode coupling region of the microwave antenna of FIG. 2.

The antenna 20 is illustrated in greater detail in FIGS. 2 and 3. A length of circular waveguide 30 has a sidewall 32 with a cylindrical internal surface 34 and a longitudinal axis 36 parallel to the cylindrical axis of the waveguide 30. There are two opposed longitudinal slots 38 and 38*a* in the sidewall 32, positioned 180 degrees apart around the circumference of the surface 34. The slots 38 extend parallel to the longitudinal axis 36. A first rectangular waveguide 40 communicates with the interior of the waveguide 30 through slot 38, and a second rectangular waveguide 42 communicates with the interior of the waveguide 30 through the other slot 38*a*. One of the first or second waveguides, here illustrated as the second rectangular waveguide 42, is shorted by a closure 44 at the end remote from the slot 38*a*. The non-shorted waveguide, here the first rectangular waveguide 40, becomes the $\Sigma_h$ port of the antenna 20, as will be described in greater detail subsequently.

A transverse closure 46 is fixed over one end of the circular waveguide 30. The transverse closure 46 has a first transverse slot 48 and a second transverse slot 50 therethrough. The transverse slots 48 and 50 are symmetrically positioned with respect to the center of the closure 46 and the longitudinal axis 36 of the circular waveguide 30. In the preferred embodiment illustrated in FIGS. 2 and 3, the slots 48 and 50 are concavely arcuate relative to the center of the closure 46 and the longitudinal axis 36 of the circular waveguide 30.

A third rectangular waveguide 52 communicates with the interior of the circular waveguide 30 through the first transverse slot 48, and a fourth rectangular waveguide 54 communicates with the interior of the circular waveguide 30 through the second transverse slot 50. Microwave energy is preferably provided to the waveguides 52 and 54 through an E-plane, folded magic Tee 56, a known type of microwave feed device available, for example, from Microwave Development Labs, Inc., Chino, Calif. A "magic Tee", also referred to in the microwave art as a matched hybrid tee, is a four-port transmission line component. One of the ports, the E-plane port, is connected in series with the two reference ports and when fed provide an equal, 180 degrees power split. The second port, the H-plate port, is connected in shunt with the same two reference ports and when fed also provides an equal in-phase power split into the reference arms. There are many types of such Tees known in the art. The preferred approach for the present application is a fold waveguide configuration.

Figure 4:
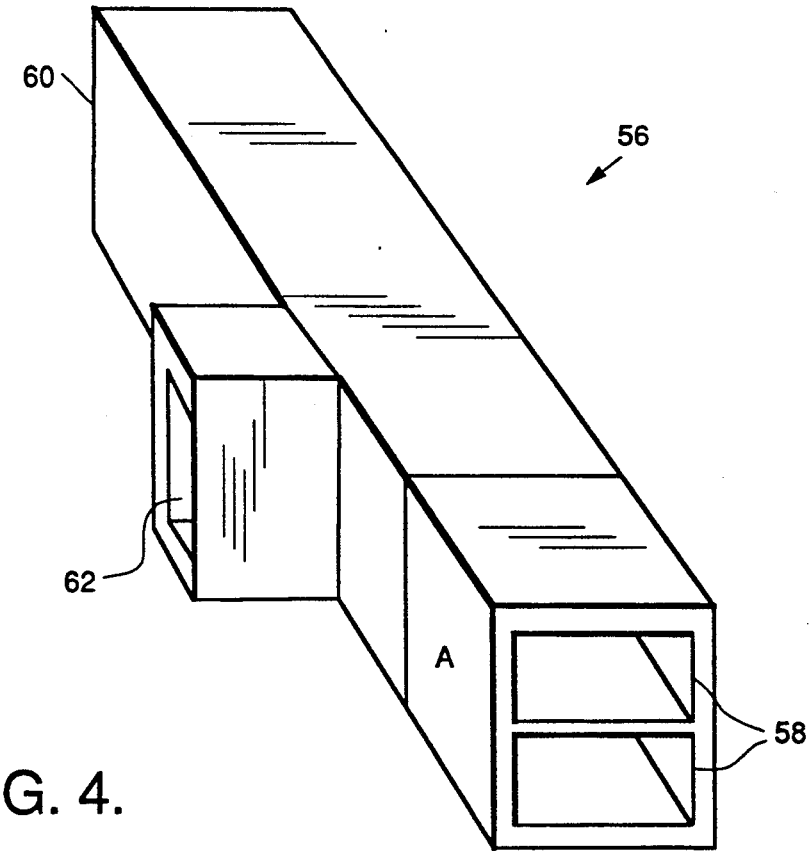
FIG. 4 is a perspective view of an E-plane folded magic Tee used to excite the arcuate slots of the transverse closure.

The E-plane, folded magic Tee 56 is illustrated in greater detail in FIG. 4. The Tee 56 is a length of metal having two interior rectangular microwave waveguides terminating in rectangular openings 58. These openings 58 are joined to the rectangular waveguides 52 and 54, to produce two continuous rectangular waveguides to the slots 48 and 50. At an intermediate location within the Tee 56, the two rectangular waveguides terminating in the openings 58 join in a single cavity. Microwave communication to the cavity is through two ports, a $\Sigma_v$ port 60 in alignment with the rectangular waveguides 52, 54 and parallel to the longitudinal axis 36, and a $\Delta$ port 62 in the sidewall of the Tee 56 and thence perpendicular to the longitudinal axis 36.

A conical horn 64 is placed in communication with the circular waveguide 30 at its end remote from the transverse closure 46 and the folded magic Tee 56. In the tracking antenna 22, the horn controls the gain and beam width. For a design of the antenna 20 to be used in the cassegrain antenna 22, the flare angle of the horn 64 was made about 10 degrees.

Figure 5:
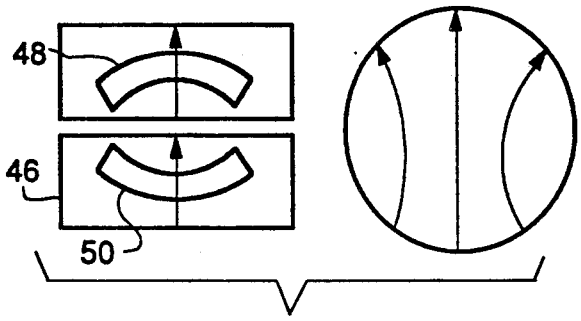
FIG. 5 is a schematic representation of the excitation of a $\Sigma_v$ mode using the antenna of the invention.

Electromagnetic energy is transmitted through the $\Sigma_v$ port 60 and the $\Sigma_h$ port, and received at all three ports 60, 62, and 40. As schematically illustrated in FIG. 5, a microwave signal is applied to the transverse slots 48 and 50 in phase, by introducing a microwave signal through the port 60, to generate a $TE_{11}$ waveguide mode in the circular waveguide 30. The field strength of this mode is a maximum in the center of the circular waveguide 30 and will radiate as a sum pattern. The top-to-bottom orientation of the field lines give this mode its name, the $\Sigma_v$ or sum-vertical mode.

Figure 6:
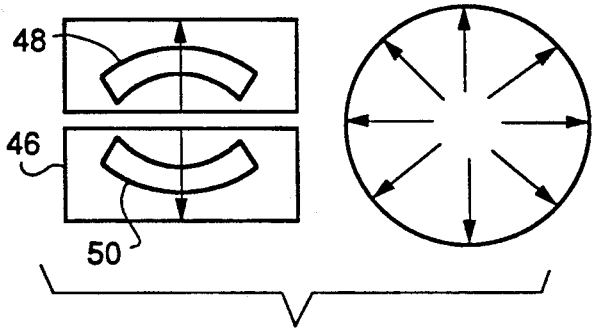
FIG. 6 is a schematic representation of the excitation of a $\Delta$ mode using the antenna of the invention.

As schematically illustrated in FIG. 6, a microwave signal is applied to the transverse slots 48 and 50 with the signals 180 degrees out of phase, by introducing a microwave signal through the $\Delta$ port 62, to generate a $TM_{01}$ circular waveguide mode. This mode has a minimum in field strength in the center of the circular waveguide 30, and radiates as a difference pattern from the circular waveguide 30.

Figure 7:
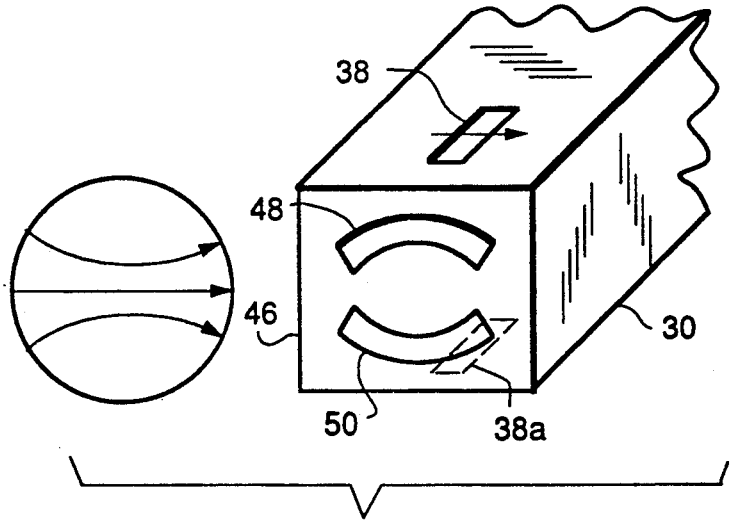
FIG. 7 is a schematic representation of the excitation of a $\Sigma_h$ mode using the antenna of the invention.

As schematically illustrated in FIG. 7, a microwave signal is applied to the longitudinal slot 38 through the first waveguide 40 to excite another $TE_{11}$ sum mode. The shorted second rectangular waveguide 42 and parasitic slot 38a optimize the match of the excited $\Sigma_h$ port 40. In the optimal version, the plane of the transverse closure 46 is placed one-quarter of a wavelength from the center of the longitudinal slots 38 and 38a to maximize the coupling of the $\Sigma_h$ port signal to the circular waveguide 30. The excited $TE_{11}$ mode is termed the sum-horizontal or $\Sigma_h$ mode, because its field is rotated 90 degrees relative to the $\Sigma_v$ plane.

If the $\Sigma_v$ and $\Sigma_h$ ports 60 and 40 are excited simultaneously in a sequential phasing, a circular polarized sum pattern is radiated.

The polarimetric antenna 20 is dimensioned in accordance with the particular wavelength of the electromagnetic signal being radiated or received, to achieve optimal performance. Some general design rules are applicable. The diameter of the circular waveguide 30 must be sufficiently large so that both the $TE_{11}$ and $TM_{01}$ modes can propagate. This rule is generally met by making the diameter of the circular waveguide 30 greater by about 20 percent than the cutoff diameter of the $TE_{11}$ mode and less than the cutoff diameter of the next high order mode, the $TE_{21}$ mode. The length of the circular waveguide 30 should be sufficiently great so that all evanescent modes that are excited by the transverse slots 48 and 50 can decay to negligible levels before entering the horn 64. This rule is generally met by making the length of the circular waveguide 30 at least as great as the microwave wavelength. The width and offset of the transverse slots 48 and 50 should be chosen to optimize the match presented to the rectangular waveguides 52 and 54 that excite the antenna. Finally, the length of all slots 38 38a, 48, and 50 should be about one-half of the free-space microwave length at the center frequency of interest.

To establish the operability of the present invention, an antenna 20 was built to operate at a center frequency of 35.0 GHz. The diameter of the circular surface 34 of the circular waveguide 30 was 0.313 inches, and the length of the circular waveguide 30 was 0.346 inches. The longitudinal slots 38 were 0.020 inches wide by 0.174 inches long. The closure 44 was placed 0.142 inches away from the circular surface 34 on the second waveguide 42. The transverse closure 46 was etched from copper sheet of thickness about 0.010 inches. The transverse slots 48 and 50 were arcuate as illustrated, and were each 0.020 inches wide by 0.167 inches long. The waveguides 40, 42, 52, and 54 were all WR-28 rectangular waveguides having a height of 0.14 inches and a width of 0.28 inches.

For a microwave feed of 35.0 GHz, the return loss was better than −15 dB over a 3 percent bandwidth. Good sum and difference patterns were measured when the $\Sigma_v$, $\Sigma_h$, and $\Delta$ ports were excited separately. When the $\Sigma_v$ and $\Sigma_h$ ports were excited simultaneously as described, a nearly circular-polarized sum pattern was measured. Isolation between the waveguide outputs 40, 56, and 62 was better than 30 dB.

The present invention provides a structurally compact, simple polarimetric antenna that may be used for a wide variety of applications, such as the feed for the cassegrain tracking antenna discussed herein. A conical horn can be attached to the antenna to control its gain and beam width. The polarimetric antenna can be used over a wide range of frequencies including submicrowave, microwave, and millimeter wave frequencies. Although particular embodiments of the invention have been described in detail for purposes of illustration, various modifications may be made without departing from the spirit and scope of the invention. Accordingly, the invention is not to be limited except as by the appended claims.

What is claimed is:

1. A polarimetric antenna, comprising:

a length of circular waveguide having a sidewall with a cylindrical internal surface, the sidewall having a first longitudinal slot and a second longitudinal slot therein, the longitudinal slots extending parallel to a longitudinal axis of the circular waveguide and being symmetrically positioned with respect to the circumference of the circular waveguide;

a first rectangular waveguide in communication with the first longitudinal slot;

a second rectangular waveguide in communication with the second longitudinal slot, the second rectangular waveguide being short circuited by a closure at an end thereof;

a transverse closure over the circular waveguide at one end thereof, the closure having a first transverse slot and a second transverse slot therein, the first and second transverse slots being symmetrically positioned on opposite sides of the longitudinal axis of the circular waveguide;

a third rectangular waveguide in communication with the first transverse slot; and a fourth rectangular waveguide in communication with the second transverse slot.

2. The antenna of claim 1, further including means for supplying electromagnetic energy to the third rectangular waveguide and to the fourth rectangular waveguide.

3. The antenna of claim 1, further including means for supplying electromagnetic energy to the third rectangular waveguide and to the fourth rectangular waveguide, the electromagnetic energy supplied to the third rectangular waveguide being in-phase with the electromagnetic energy supplied to the fourth rectangular waveguide.

4. The antenna of claim 1, further including means for supplying electromagnetic energy to the third rectangular waveguide and to the fourth rectangular waveguide, the electromagnetic energy supplied to the third rectangular waveguide being 180 degrees out of phase with the electromagnetic energy supplied to the fourth rectangular waveguide.

5. The antenna of claim 1, further including an E-plane, folded magic Tee that supplies electromagnetic energy to the third rectangular waveguide and to the fourth rectangular waveguide.

6. The antenna of claim 1, further including a conical horn in communication with the end of the circular waveguide remote from the end having the transverse closure.

7. The antenna of claim 1, the first transverse slot and the second transverse slot each being concavely arcuate relative to the longitudinal axis of the circular waveguide.

8. The antenna of claim 1, wherein the dimensions of the antenna are optimized for a preselected frequency of electromagnetic energy, and wherein both a $TE_{11}$ mode and $TM_{01}$ mode of the preselected frequency can propogate through the circular waveguide.

9. The antenna of claim 1, wherein the dimensions of the antenna are optimized for a preselected frequency of electromagnetic energy, and wherein all evanescent modes that are excited in the circular waveguide may decay to negligible levels within the circular waveguide before leaving the antenna.

10. The antenna of claim 1, wherein the dimensions of the antenna are optimized for a preselected frequency of electromagnetic energy, and wherein the length of each of the two longitudinal and the two transverse slots is about one-half of the free-space wavelength of the preselected frequency of electromagnetic energy.

11. The antenna of claim 1, wherein the dimensions of the antenna are optimized for a preselected frequency of electromagnetic energy, and wherein the transverse closure is spaced from the longitudinal slots by a distance of one-quarter of the waveguide wavelength of the preselected frequency of the electromagnetic energy.

12. The antenna of claim 1, wherein the dimensions of the antenna are optimized for a preselected frequency within the microwave range.

13. The antenna of claim 1, wherein the dimensions of the antenna are optimized for a preselected frequency within the millimeter wave range.

14. A polarimetric antenna, comprising:

a length of circular waveguide having a sidewall with a cylindrical internal surface, the sidewall having a first longitudinal slot and a second longitudinal slot therein, the longitudinal slots extending parallel to a longitudinal axis of the circular waveguide and being symmetrically positioned with respect to the circumference of the circular waveguide;

a first rectangular waveguide in communication with the first longitudinal slot;

a second rectangular waveguide in communication with the second longitudinal slot, the second rectangular waveguide being short circuited by a closure at an end thereof;

a transverse closure over the circular waveguide at one end thereof, the closure having a first transverse slot and a second transverse slot therein, the first and second transverse slots being positioned symmetrically with respect to the longitudinal axis of the circular waveguide, the first transverse slot and the second transverse slot each being concavely arcuate relative to the longitudinal axis of the circular waveguide;

a third rectangular waveguide in communication with the first transverse slot;

a fourth rectangular waveguide in communication with the second transverse slot; and an E-plane, folded magic Tee that supplies microwave feeds to the third rectangular waveguide and to the fourth rectangular waveguide.

* * * * *